United States Patent [19]

Vink et al.

[11] Patent Number: 5,013,964

[45] Date of Patent: May 7, 1991

[54] METHOD OF MANUFACTURING A SADDLE-SHAPED DEFLECTION COIL FOR A PICTURE DISPLAY TUBE AND DISPLAY TUBE COMPRISING A DEFLECTION SYSTEM USING SADDLE-SHAPED DEFLECTION COILS

[75] Inventors: Nicolaas G. Vink; Franciscus C. A. J. Jacobs; Franciscus M. P. P. Doomernik, all of Eindhoven, Netherlands

[73] Assignee: U.S. Philips Corporation, New York, N.Y.

[21] Appl. No.: 416,185

[22] Filed: Oct. 2, 1989

[30] Foreign Application Priority Data

Oct. 27, 1988 [NL] Netherlands ..... 8802641

[51] Int. Cl.[5] ..... H01J 29/70; H01H 1/00

[52] U.S. Cl. ..... 313/440; 335/213

[58] Field of Search ..... 313/440; 335/210, 213

[56] References Cited

U.S. PATENT DOCUMENTS

| | | | |
|---|---|---|---|
| 4,039,988 | 8/1977 | van der Heijde | 335/210 X |
| 4,039,989 | 8/1977 | Staal et al. | 335/210 X |
| 4,612,525 | 9/1986 | Sluyterman et al. | 313/426 |

*Primary Examiner*—Sandra L. O'Shea

*Attorney, Agent, or Firm*—Robert J. Kraus

[57] ABSTRACT

Method of continuously winding in a gap-shaped winding space a saddle-shaped, flared deflection coil having a flange-shaped connection portion at its widest and extending transversely to the longitudinal axis. Since at least one symmetrical pair of pins is introduced at the front end of the coil into the winding space transversely to the plane of the flange-shaped connection portion and at least one further symmetrical pair of pins is introduced at the front end of the coil into the winding space transversely to the plane of the longitudinal turns, the designer of the coil is given an extra modulation possibility which can be utilized, for example to further reduce the east-west raster distortion.

5 Claims, 3 Drawing Sheets

METHOD OF MANUFACTURING A SADDLE-SHAPED DEFLECTION COIL FOR A PICTURE DISPLAY TUBE AND DISPLAY TUBE COMPRISING A DEFLECTION SYSTEM USING SADDLE-SHAPED DEFLECTION COILS

BACKGROUND OF THE INVENTION

The invention relates to a method of continuously winding a saddle-shaped deflection coil flaring out from a rear end towards a front end, of the type whose front end has a flange-shaped connection portion extending transversely to the longitudinal axis, for use in picture display tubes, the longitudinal turns of the coil being distributed over a number of sections and each turn of a section surrounding the turns of the previous sections and each pair of adjoining sections being separated over a part of its length by at least one aperture which is formed in that a pin is introduced at the front end into the winding space in at least two positions which are symmetrical relative to the longitudinal axis along the boundary between the two sections and after providing the number of turns desired for the first of these two sections, whereafter the second section is wound around said pins. The invention also relates to a deflection system for a picture display tube, comprising at least two saddle-shaped deflection coils surrounding the system symmetrically relative to the longitudinal axis and flaring out from the rear to the front, the front end of each coil having a flange-shaped connection portion extending transversely to the tube axis, and between which coils two longitudinal portions extend on either side of a window.

The above-mentioned method is commonly used for winding saddle-shaped coils. In this method the properties of the coil may be influenced by determining the position of the open spaces during the design and by choosing the number of turns per section during winding. In many cases this sprovides the possibility of adapting the distribution of the magnetic flux generated by the coil to the requirements imposed. However, it has been found that this possibility is not adequate in all cases, particularly when more refined corrections are to be performed. Such corrections are necessary, for example, if the east-west raster error is to be reduced in colour display tubes of the in-line type.

Increasingly stringent requirements are imposed on the performance of colour display tubes using electromagnetic deflection units, particularly when they are used in monitors. Stringent requirements are imposed, for example on the shape of the raster.

In conventional TV receivers or in monitors a raster is constituted by causing an electron beam to scan the front plate of the display tube. The (geometrical) raster errors which may occur are north-south raster errors (errors on the upper and lower side of the raster) and east-west raster errors (errors on the left and right-hand side of the raster). In colour display tubes having an in-line arrangement of the electron guns the east-west raster error becomes manifest as a pincushion or barrel-shaped distortion of the left and right-hand boundary of the raster scanned on the display screen.

SUMMARY OF THE INVENTION

It is an object of the invention to improve the method of the type described in the opening paragraph in such a way that the designer of the coil is given an extra possibility to influence the distribution of the generated magnetic flux.

To this end the method according to the invention is characterized in that at least one symmetrical pair of pins is introduced at the front end of the coil into the winding space transversely to the plane of the flange-shaped connection portion and in that at least one further symmetrical pair of pins is introduced at the front end of the coil into the winding space transversely to the plane of the longitudinal turns of the coil.

The method according to the invention is applicable to winding field deflection coils as well as line deflection coils.

At positions where pins are introduced near the front end into the winding space transversely to the plane of the flange-shaped connection portion of the coil, the transition between the longitudinal part of a turn and the flange-shaped connection portion will be at a different axial position (further to the front in the) method according to the invention than at positions where pins are introduced near the front end transversely to the plane of the longitudinal parts of the turns. This creates an extra field modulation, because a stronger deflection field component is locally produced at positions where the transition is located further to the front. It depends on the radial position of the said transition which field component is additionally generated. This provides the possibility of giving, for example a field deflcetion coil of the saddle type such a distribution of turns near its front end by selectively using the directions of positioning the pins during winding that, upon energization, an extra strong positive six-pole component is generated with which the east-west raster distortion is reduced.

For a setmaker this means that he can omit certain raster correction magnets or raster correction circuits hitherto required.

A deflection coil which is manufactured for a display tube comprising a deflection system by means of the method according to the invention is characterized in that the longitudinal parts of the turns are divided into a number of sections, the transition between each longitudinal section and the flange-shaped connecting portion at the front end being marked by a linear face which is either transverse to the plane of the flange-shaped connection portion or transverse to the plane of the longitudinal parts of the turns.

According to the invention a preferred embodiment of a display tube comprising a deflection system using two deflection coils of this type is characterized in that the deflection coils are positioned so as to generate a vertical deflection field upon energization.

A further preferred embodiment is characterized in that the at least two saddle-shaped coils arrranged symmetrically relative to the longitudinal axis of the system have linear transition faces which are transverse to the plane of the flange-shaped connection portion and which are located at angular position of approximately 30° around the longitudinal axis.

Another preferred embodiment is characterized in that the at least two saddle-shaped coils arranged symmetrically relative to the longitudinal axis of the system have further linear transition faces which are transverse to the plane of the longitudinal parts of the turns and which are located at angular positions of approximately 15°, 40°, 50° and 60°, respectively, around the longitudinal axis.

BRIEF DESCRIPTION OF THE DRAWING

Some embodiments of the invention will now be described in greater detail with reference to the accompanying drawing figures in which.

DESCRIPTION OF THE PREFERRED EMBODIMENT

Figure 1:
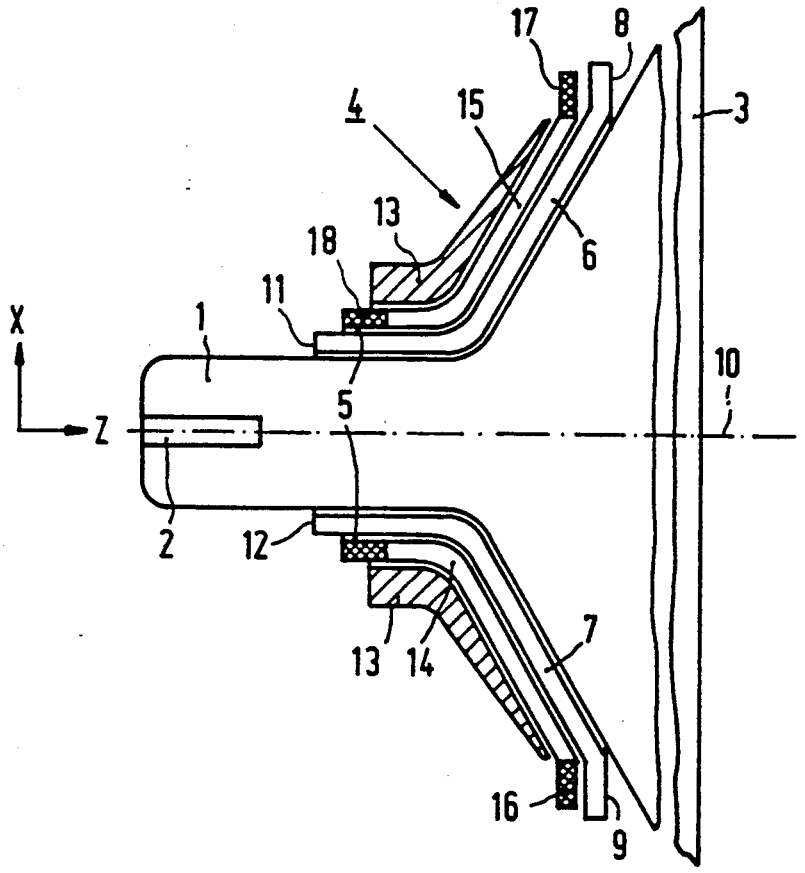
FIG. 1 is a longitudinal cross-section of a part of a picture display tube including a deflection system.

FIG. 1 shows a colour display tube 1 comprising an electron gun system 2 for generating three electron beams directed towards a display screen 3 having a repetitive pattern with red, green and blue phosphor elements. An electromagnetic deflection system 4 is arranged coaxially with the axis of the tube around the path of the electron beams between the electron gun system 2 and the display screen 3. The deflection system 4 comprises a funnel-shaped sythethic material coil support 5 supporting on its inside a line deflection coil system 6, 7 for deflecting the electron beams generated by the electron gun system 2 in the horizontal direction. The flared line deflection coils 6, 7 are of the saddle type and have a front flange 8, 9 at their widest end, which flange is substantially transverse to the axis 10 of the display tube. At their narrowest end the coils 6, 7 comprise packets of connection wires 11, 12 interconnecting the axial conductor packets of each of the coils 6, 7 and being arranged substantially parallel to the outer surface of the display tube 1. In the case shown the coils 6, 7 thus are of the type having a "lying" rear flange and an "upstanding" front flange. Alternatively, they may be of the type having both an upstanding rear flange and an upstanding front flange.

On its outer side the coil support 5 supports two saddle-shaped field deflection coils 14, 15 for deflecting electr*on beams generated by the electron gun system 3 in the vertical direction. A ferromagnetic annular core 13 surrounds the two coil assemblies. In the case shown the field deflection coils are of the type having an upstanding front flange 16, 17 and a lying rear flange. Alternatively, they may be of the type having both an upstanding rear flange and an upstanding front flange.

Figure 2:
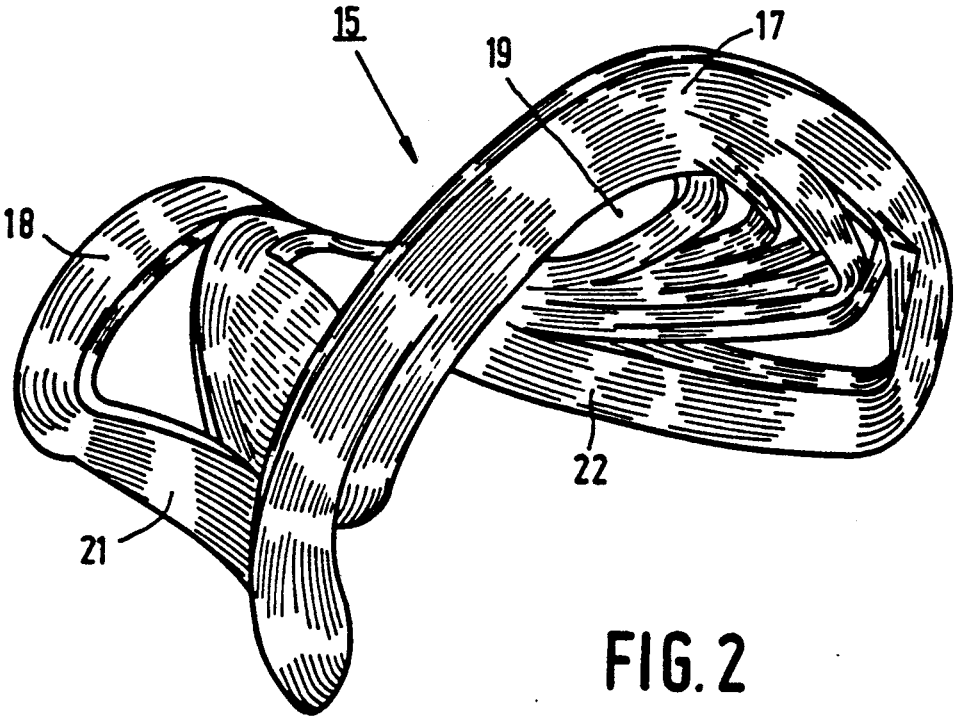
FIG. 2 is a prespective elevational view of a deflection coil according to the invention.

FIG. 2 shows a field deflection coil in an elevational view, that is to say, viewed from the right in FIG. 1. This coil comprises a number of turns of, for example copper wire and has a rear end portion 18 and a front end portion or flange 17 between which two active portions 21, 22 extend on either side of a window 19. As is apparent from FIG. 1, the front end portion 17 is "upstanding" so that its wires are further remote from the electron beams to be deflected than in the case that it would be "lying". In the embodiment shown the rear end portion 18 "is lying". It will be clear that using a coil having an upstanding rear end portion or a lying rear end portion is a design parameter which is not connected with the measures according to the invention. All these possible embodiments are comprised under the term "saddle-shaped" deflection coils. The coil 15 flares out from the rear to the front so that it is adapted to the trumpet shape of the portion 5 of the picture display tube.

Figure 3:
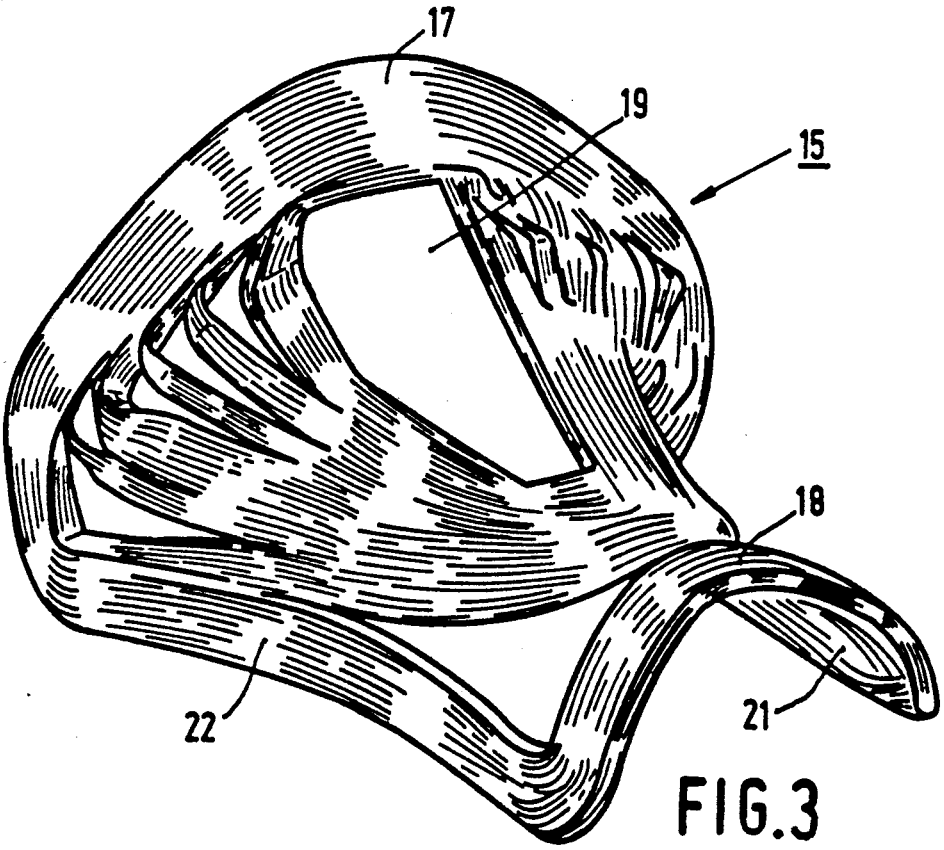
FIG. 3 is a perspective rear view of a deflection coil according to the invention.
Figure 4:
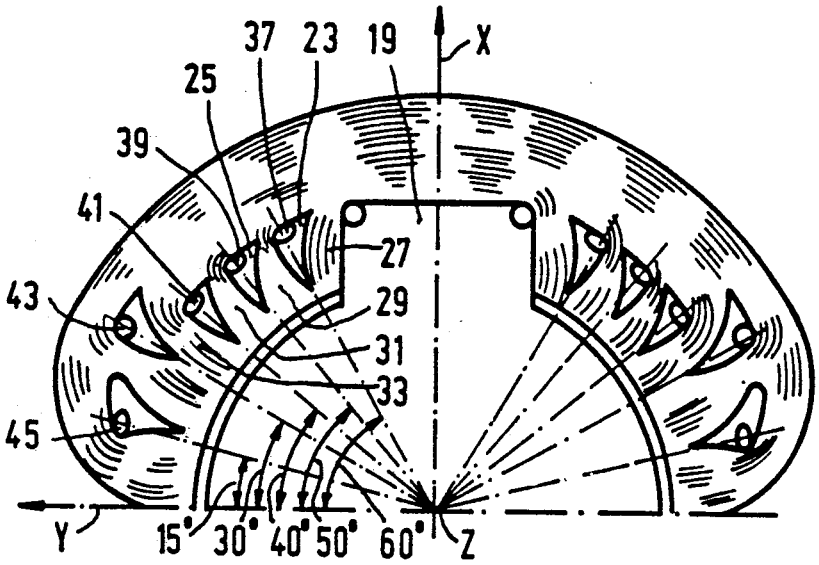
FIG. 4 is a diagrammatic rear view of a cross-section through the deflection coil of FIG. 3.

The magnetic flux required for the vertical deflection of the electron beams is substantially entirely generated in the active portions 21, 22. The flux generated in the end portions 18 and 17 substantially does not contribute to the deflection. Each of the active poritons 21, 22 has apertures near the front end. These apertures divide the coil 15 into a number of sections, as is even more clearly shown in FIG. 3, and the field deflection coil 15 shown by way of example has six sections. Each turn of a section surrounds the turns of the sections located more inwards (closer to the window 19). By choosing the number, the position and the shape of the apertures near the front end as well as the number of turns in each of the sections, a designer can influence the distribution of the magnetic flux generated in the active portions 21, 22 to a considerable and very acurate extent. It is very favourable that the axial position of the transition between the active turn poritons and the flange can be varied. This freedom of choice give the designer a considerably greater influence on the distribution of the generated magnetic flux during the winding operation. The winding opertion itself will now be described with reference to FIGS. 4 and 5. FIG. 4 is a partial rear view of a cross-section of the coil shown in FIG. 2 during the winding operation. Winding is effected in a winding space which is recessed in a jig 50 shown in FIG. 5, which forms part of a winding machine. To simplify the Figure the winding machine is not shown. The jig 50 comprises two halves 51 and 52 between which a winding space 53 is recessed and which is bounded by walls 54, 55 whose shape corresponds to the outer boundaries of the coil to be wound.

During the winding operation the inner coil section 27 is wound first, for example around a mandril defining the shape of the window 19. As soon as the number of turns required for the section 27 is reached, pins 37 which are approximately perpendicular to the plane of the turns are substantially simultaneously introduced into the winding space at the boundary between this section and the next section 29. The first turn of the next section 29 is now laid around the pins 37 so that the apertures 23 are created between the sections 27 and 29 in the active portion 21. After the required number of turns of the second section 29 is reached, pins 39 which are approximately perpendicular to the plane of the turns are introduced in an analogous manner into the winding space at the boundary between this section and the next section while the first turn of the third section 31 is laid around these pins. This creates the apertures 25. Winding is effected continuously, that is to say the wire runs uninterrupted from one section to the next.

The apertures 23 and 25 approximately have the shape of a triangle. One side of this polygon coincides with the last turn of the section preceding the relevant aperture and the other sides coincide with the first turn of the section following the aperture. The variation of the last turn of a section is determined by the location of the preceding turns of this section and this variation will generally not be strictly rectilinear but slightly curved. In the example of FIG. 4 pins 41 which are also perpendicular to the plane of the turns are introduced into the winding space after providing section 31, whereafter section 33 is wound.

Figure 5:
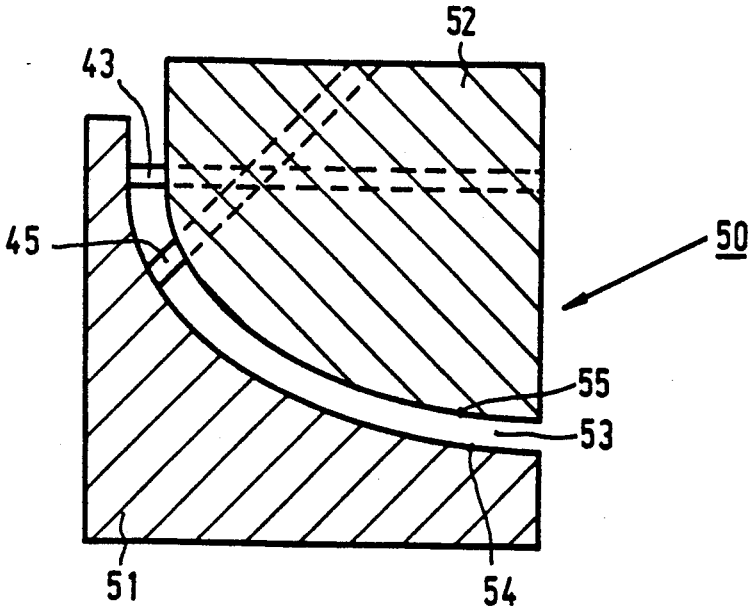
FIG. 5 is a cross-section of a winding jig for use of the method according to the invention.

The subsequent pins 43 are not introduced approximately perpendicularly to the plane of the turns but approximately perpendicularly to the plane of the flange, as will be explained with reference to FIG. 5. The transition between the axial portions of the turns to the flange portion will therefore be located further to the exterior so that a field modulation can be realised. In a field deflection coil the pins 43 may be arranged, for example in a radial position of approximately 30° so as to locally generate an extra positive six-pole component (for reducing the east-west raster distortion). In such a design of the field deflection coil the pins 37, 39, 41 and 45 (not referred to) may be located at angular positions of approximately 60°, 50°, 40° and 15° around the longitudinal axis z and relative to the vertical axis y.

The winding method according to the invention may, however, also be used to advantage when winding line deflection coils.

When magnetic fields having different properties must be generated, the pins may of course be introduced at different positions. The number of pins may differ from the number given in the example. The coil described with reference to FIGS. 4 and 5 is symmetrical with respect to the x-z plane, i.e. the apertures 23, 25 located to the left and right of this plane are inverted images of each other and the number of turns in the section portions located on either side of this plane is the same.

We claim:

1. A deflection system for a picture display tube, comprising at least first and second saddle shaped deflection coils flaring out from a rear end toward a front end and arranged symmetrically relative to a longitudinal axis of the system, each of said coils including a flange connection portion extending transversely to the longitudinal axis at the front end, a connection portion at the rear end, and a plurality of longitudinal parts extending between said front and rear ends and formed by a plurality of winding sections of said coil, characterized in that each of said sections includes transition portions between the longitudinal parts and the front end of the respective coil, a first plurality of said transition portions located at first preselected angular positions around the longitudinal axis forming linear faces which are substantially transverse to the flange shaped connection portion, and a second plurality of said transition portions located at second preselected angular positions around the longitudinal axis forming linear faces which are substantially transverse to the longitudinal parts.

2. A deflection system as in claim 1 where the first and second saddle shaped deflection coils are arranged on opposite sides of a vertical axis which is perpendicular to the longitudinal axis and are positioned to effect the production of a vertical deflection field upon energization.

3. A deflection system as in claim 2 where at least one of the first plurality of transition portions is disposed at an angular position of approximately 30° relative to the vertical axis.

4. A deflection system as in claim 3 having ones of the second plurality of transition portions disposed at angular positions of approximately 15°, 40°, 50° and 60°, respectively, relative to the vertical axis.

5. A method of continuously winding a saddle shaped deflection coil for a picture display tube, said coil extending along a longitudinal axis and flaring out from said axis from a rear end toward a front end, including a flange shaped connection portion extending transversely to the axis at the front end, a connection portion at the rear end, and a plurality of longitudinal parts extending between said front and rear ends and formed by a plurality of winding sections of said coil, each section surrounding a previously wound section and including a transition portion between the respective longitudinal part and the front end of the coil, characterized in that a first plurality of said transition portions located at first preselected angular positions around the longitudinal axis are wound around a plurality of pins which are oriented substantially transversely to the flange shaped connection portion, and a second plurality of said transition portions located at second preselected angular positions around the longitudinal axis are wound around a plurality of pins which are oriented substantially transversely to the longitudinal parts.

* * * * *